United States Patent [19]

Colato

[11] Patent Number: 4,713,513

[45] Date of Patent: Dec. 15, 1987

[54] MICROWAVE OVEN TURNTABLE SHELF STRUCTURE

[75] Inventor: Albert E. Colato, Woodbury, Minn.

[73] Assignee: Plastics, Inc., Minneapolis, Minn.

[21] Appl. No.: 869,599

[22] Filed: Jun. 2, 1986

Related U.S. Application Data

[62] Division of Ser. No. 47,016, Jun. 11, 1979, Pat. No. 4,593,171.

[51] Int. Cl.[4] ..... H05B 6/78

[52] U.S. Cl. ..... 219/10.55 F; 219/10.55 E; 99/DIG. 14; 126/338

[58] Field of Search ..... 219/10.55 F, 10.55 E, 219/10.55 R; 99/417, 416, 451, DIG. 14; 126/338, 337 R

[56] References Cited

U.S. PATENT DOCUMENTS

| | | | |
|---|---|---|---|
| 106,457 | 8/1870 | Berry | 99/417 |
| 341,878 | 5/1886 | Chipley | 99/417 |
| 3,428,772 | 2/1969 | Wallenfels | 219/10.55 F |
| 3,641,926 | 2/1972 | Williams et al. | 99/417 X |
| 4,074,102 | 2/1978 | Asen | 219/10.55 E |
| 4,080,524 | 3/1978 | Greenfield, Jr. et al. | 219/10.55 F X |
| 4,092,512 | 5/1978 | Suzuki et al. | 219/10.55 E X |
| 4,283,614 | 8/1981 | Tanaka et al. | 219/10.55 F |
| 4,286,133 | 8/1981 | Einset et al. | 219/10.55 F |

*Primary Examiner*—Philip H. Leung
*Attorney, Agent, or Firm*—Flehr, Hohbach, Test, Albritton & Herbert

[57] ABSTRACT

A shelf structure is provided for use with a turntable in a microwave oven. The shelf structure includes a food-supporting platform and a base which rests on the table of the turntable. A first food product is placed on the turntable, and a second food product is placed on the platform above the first. When microwave energy is introduced toward the top of the oven cavity, the food product on the platform is exposed to more of the energy than is the food product on the turntable, and therefore tends to cook at a faster rate.

2 Claims, 4 Drawing Figures

MICROWAVE OVEN TURNTABLE SHELF STRUCTURE

This is a division of application Ser. No. 047,016 filed June 11, 1979, now U.S. Pat. No. 4,593,171, issued June 3, 1986.

This invention pertains generally to microwave ovens and more particularly to a method and apparatus for simultaneously cooking two or more food products at different rates in a microwave oven.

In recent years, microwave ovens have enjoyed widespread popularity due to their ability to heat or cook many food products more rapidly than do conventional ovens and other cooking methods. However, because of uneven distribution of microwave energy in the oven cavity, food tends to cook unevenly in a microwave oven, and turntables are sometimes employed for the purpose of moving the food to provide more uniform cooking.

It is sometimes desirable to cook more than one food product at one time, and this is generally difficult in a microwave oven due to the different cooking rates and/or cooking times required by different products. In order to have different foods ready to serve at approximately the same time, it is generally necessary to begin cooking the food with the longest cooking time first, then add the others as the cooking progresses. This requires frequent attention on the part of the cook, and because the cooking times of foods in microwave ovens change when other foods are present, it is difficult to predict the cooking times required for the different foods.

It is in general an object of the invention to provide a new and improved method and apparatus for simultaneously cooking a plurality of food products in a microwave oven.

Another object of the invention is to provide a method and apparatus of the above character wherein the food products are cooked at different rates.

These and other objects are achieved in accordance with the invention by providing a shelf structure for use with a turntable in a microwave oven. The shelf structure includes a food-supporting platform and a base which rests on the table of the turntable. A first food product is placed on the turntable, and a second food product is placed on the platform above the first. When microwave energy is introduced toward the top of the oven cavity, the food product on the platform is exposed to more of the energy than is the food product on the turntable, and therefore tends to cook at a faster rate.

Figure 1:
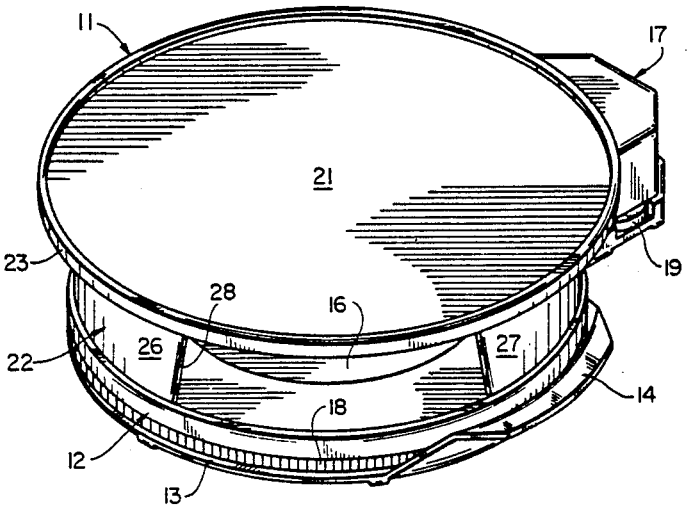
FIG. 1 is an isometric view of one embodiment of a shelf structure and turntable according to the invention.
Figure 2:
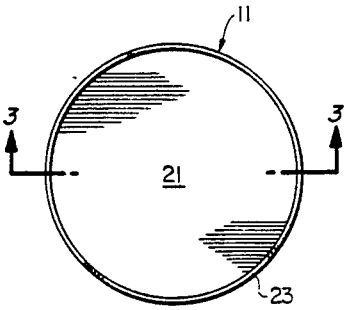
FIG. 2 is a top plan view of the shelf structure of FIG. 1.

In the drawings, the shelf structure (designated 11) is illustrated in connection with a turntable 12 which is adapted to be inserted into and removed from the cooking cavity of a microwave oven. The turntable includes a generally planar base 13 with outwardly projecting handles 14 on opposite sides thereof. A table 16 is rotatively mounted on the base and driven by a drive motor assembly 17 mounted on the base to one side of the table. The motor assembly includes a suitable drive motor such as an electrically powered motor or a spring-powered motor and a suitable transmission or gear train.

An output gear of the transmission engages a peripheral ring of gear teeth 18 on the table for rotating the table at the desired speed, e.g., about 0.5–1 rpm.

Base 13 and table 16 are preferably fabricated of a material which is transparent to microwave energy so that they will not interfere with the distribution of microwave energy in the oven cavity. Suitable materials include a modified thermosetting polyester as used in MICROWARE cookware developed by Plastics, Inc., a subsidiary of Anchor Hocking Corp.; polysulfone; thermoplastic polyesters; polypropylene; polycarbonate; polystyrene; acrylonitrile; butadiene styrene; polyphenylene oxide; acrylic, polyethylene and other materials which in certain instances may be partially reflective or absorbent to microwaves in order to provide a desired effect such as browning of a food product.

The drive motor and transmission are enclosed is a housing of metal or other material which is reflective to microwave energy and are thereby shielded from the radiation in the oven cavity. The outer surface of the housing is covered by a layer of electrically insulative material to prevent arcing. The output gear is mounted outside the housing on a shaft which passes through a wall of the housing in a cut-off tube, and an on/off switch 19 accessible externally of the housing controls the operation of the drive motor. A turntable of this general character is described in greater detail in copending application Ser. No. 897,048, filed Apr. 17, 1978, now abandoned. The use of the shelf structure is not limited to this particular turntable, and it can be used equally well with other portable turntables and with turntables which are built into an oven as an integral part thereof.

The shelf structure includes a base 21 adapted to rest on the table of the turntable and a platform 22 supported by the base at a predetermined distance above the table. The platform is circular in plan view and generally planar, with a peripheral rim or flange 23. Although illustrated as a solid structure, platform 21 can be constructed in the form of a rack or grill.

Figure 4:
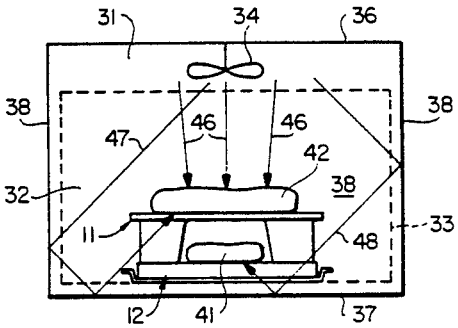
FIG. 4 is an elevational view, somewhat schematic, illustrating the use of the shelf structure and turntable of FIG. 1 in a microwave oven.
Figure 3:
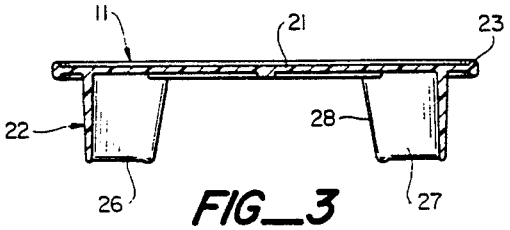
FIG. 3 is an enlarged cross-sectional view taken along line 3—3 in FIG. 2.

The base comprises a plurality of legs 26,27 which are spaced peripherally about the platform, with openings 28 between adjacent ones of the legs. The platform is of greater lateral extent than the base, and it overhangs the base at the sides of the structure. As best seen in FIG. 4, legs 26,27 are upwardly and inwardly inclined, and the upper portions of the legs are inset from the peripheral edge of the platform. In the preferred embodiment, platform 21 and base 22 are formed as a unitary structure by a suitable process such as molding. Like the table and base of the turntable, they are preferably fabricated of a material which is transparent to microwave energy so that they will not interfere with the distribution of microwave energy in the oven cavity. Suitable materials for the shelf structure include those specified above for the turntable base and table. Alternatively, the shelf structure can be fabricated of a material such as glass, with an enclosed base so that steam produced by the food on the turntable will be confined within the base and provide additional heating of the food on the platform of the shelf structure. This conductive heat transfer would complement the microwave cooking of the food on the shelf structure.

Operation and use of the turntable and shelf, and therein the method of the invention, can best be understood with reference to FIG. 4. There the turntable and shelf are illustrated in connection with a microwave oven 31 of conventional design. The oven has a cooking cavity 32 defined by a liner 33. A magnetron tube (not shown) generates microwave energy at a suitable frequency, e.g., 2450 MHz, and this energy enters the upper portion of the cavity and is dispersed to a certain extent by a mode stirrer 34. The liner itself is transparent to microwave energy, and reflective walls 36,38 are provided outside the liner at the top, bottom and sides of the oven. The energy entering the upper portion of the cavity is reflected by the walls and directed toward the food to be cooked.

Turntable 12 is placed on the floor of cavity 32, with motor assembly 17 in a corner of the cavity where it will not interfere appreciably with the distribution of the microwave energy in the cavity. A first food product 41 is placed on the table of the turntable. The shelf structure is placed on the turntable, with the legs of base 22 resting on the upper surface of the table, and a second food product 42 is placed on the platform of the shelf structure directly above the product on the turntable. When the drive motor of the turntable is actuated, the shelf structure rotates with the table, and both of the food products are moved.

Some of the microwave energy entering the cavity passes directly to the food carried by the shelf structure, as indicated by arrows 46. Other portions of the radiation are reflected by one or more of the oven walls and ultimately reach the food on the shelf structure, as illustrated by arrow 47. Still other portions of the radiation are reflected by the oven walls and reach the food product on the turntable, as illustrated by arrow 48. Being located closer to the top of the cavity where the energy is introduced, the food product on the shelf structure tends to receive and absorb more of the microwave energy than does the product on the turntable itself. Therefore, the food product on the shelf structure tends to cook at a faster rate than does the product on the turntable itself. It is therefore possible to cook different food products simultaneously at different rates and for the food products to be ready for serving at the same time.

It is apparent from the foregoing that a new and improved method and apparatus have been provided for simultaneously cooking two or more food products at different rates in a microwave oven. While only certain presently preferred embodiments have been described in detail, as will be apparent to those familiar with the art, certain changes and modifications can be made without departing from the scope of the invention as defined by the following claims.

What is claimed is:

1. In apparatus for use in cooking food products in a microwave oven: a portable turntable having a base adapted to rest on a supporting surface in the oven cavity, a table rotatively mounted on the base, and a drive motor for rotating the table about a vertically extending axis, said turntable being adapted to be freely inserted into and removed from the cavity of the microwave oven, and a shelf structure removably mounted on the turntable having a horizontally extending platform for receiving a first food product and a plurality of legs depending from the platform and adapted to rest on the table of the turntable with the platform being spaced above the table by a distance great enough to permit a second food product to be heated on the table beneath the platform and the legs being spaced apart with an opening between two of the legs large enough to permit the second food product to be placed on and removed from the table without removing the shelf structure from the turntable.

2. The apparatus of claim 1 wherein the shelf structure platform is of greater lateral extent than the legs, and the peripheral edge portion of the platform extends laterally beyond the legs.

* * * * *